US009609419B2

(12) United States Patent
Taite et al.

(10) Patent No.: US 9,609,419 B2
(45) Date of Patent: Mar. 28, 2017

(54) CONTEXTUAL INFORMATION WHILE USING HEADPHONES

(71) Applicant: Intel Corporation, Santa Clara, CA (US)

(72) Inventors: Shahar Taite, Kfar Saba (IL); Tomer Rider, Naahryia (IL); Raphael Sack, Mitzpe Amuka (IL); Igor Ljubuncic, Chiswick London (GB)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 14/749,153

(22) Filed: Jun. 24, 2015

(65) Prior Publication Data

US 2016/0381450 A1 Dec. 29, 2016

(51) Int. Cl.
*H04R 1/10* (2006.01)
*G08B 3/10* (2006.01)

(52) U.S. Cl.
CPC ..... *H04R 1/1041* (2013.01); *G08B 3/10* (2013.01)

(58) Field of Classification Search
CPC ..... H04R 1/1041; G08B 3/10
See application file for complete search history.

(56) References Cited

U.S. PATENT DOCUMENTS

2002/0168990 A1* 11/2002 Valade ..... H04M 1/7253 455/466
2004/0193426 A1* 9/2004 Maddux ..... G06Q 30/02 704/275
2006/0223547 A1* 10/2006 Chin ..... G06F 1/3287 455/456.1
2007/0041522 A1* 2/2007 Abella ..... H04M 3/5307 379/88.14
2007/0293276 A1* 12/2007 Ushijima ..... H04M 19/04 455/567
2008/0112567 A1* 5/2008 Siegel ..... H04R 1/10 381/58
2009/0133051 A1* 5/2009 Hildreth ..... H04N 5/4403 725/28
2010/0075606 A1* 3/2010 Hargreaves ..... G10L 19/173 455/41.3
2010/0150383 A1* 6/2010 Sampat ..... H04R 1/10 381/311
2011/0037605 A1* 2/2011 Robison, Jr. ..... G08B 13/1672 340/686.1
2013/0142365 A1* 6/2013 Lord ..... H04M 3/42391 381/312
2014/0112244 A1* 4/2014 Lindner ..... H04L 65/4061 370/328

* cited by examiner

*Primary Examiner* — Simon Sing
(74) *Attorney, Agent, or Firm* — Schwegman Lundberg & Woessner, P.A.

(57) ABSTRACT

Various systems and methods for providing contextual information to a user while the user is wearing headphones are described herein. A system for providing contextual information while wearing headphones comprises an event detector module to detect an event external and proximate to a user device, the user device communicatively coupled to headphones worn by a user, the headphones producing sound at a first volume; a notification decision module to determine whether to notify the user of the event; and a notification module to notify the user of the event based on the determination.

22 Claims, 4 Drawing Sheets

CONTEXTUAL INFORMATION WHILE USING HEADPHONES

TECHNICAL FIELD

Embodiments described herein generally relate to audio processing and in particular, to a system for providing contextual information to a user while the user is wearing headphones.

BACKGROUND

Headphones are used to listen to music, participate in a phone call, or otherwise listen to audio media. Headphones include one or two speakers that are typically enclosed in a housing to hold the speakers near or inside a user's ear or ears. Headphones may also be referred to as earphones, cans, or earbuds. Headphones that include a microphone are referred to as a headset.

BRIEF DESCRIPTION OF THE DRAWINGS

In the drawings, which are not necessarily drawn to scale, like numerals may describe similar components in different views. Like numerals having different letter suffixes may represent different instances of similar components. Some embodiments are illustrated by way of example, and not limitation, in the figures of the accompanying drawings in which.

DETAILED DESCRIPTION

Systems and methods described herein provide a system for providing contextual information to a user while the user is wearing headphones. Headphones may be distracting to a user. Headphones may be over-the-ear or in-ear. Some over-the-ear headphones are designed to completely engulf the ear. Regardless of the actual design, to provide the best soundstage for the user, headphones are designed to block or mute ambient noise. As such, using headphones may make users unaware of events occurring around them. For example, a user may miss a friend calling her from across the street, miss his destination while riding the train because he did not hear the stop being called out, or even worse, miss a security warning such as a fire alarm while at work or an ambulance while biking on the road.

The present disclosure discusses an improvement to the operation of a headphone system. The headphone system is able to monitor the ambient noises around the user and provide a notification for the user when it is appropriate. In this manner, the system described herein introduces ways to deal with the user's inattention while allowing a stress free audio experience.

The system identifies events that a user should be aware of, but may fail to notice due to the usage of headphones. The system utilizes natural language processing and contextual information, which may include use of sensor information, to determine proximate events and then notify the user over one or more form factors (e.g., smartphone, smartwatch, etc.).

Figure 1:
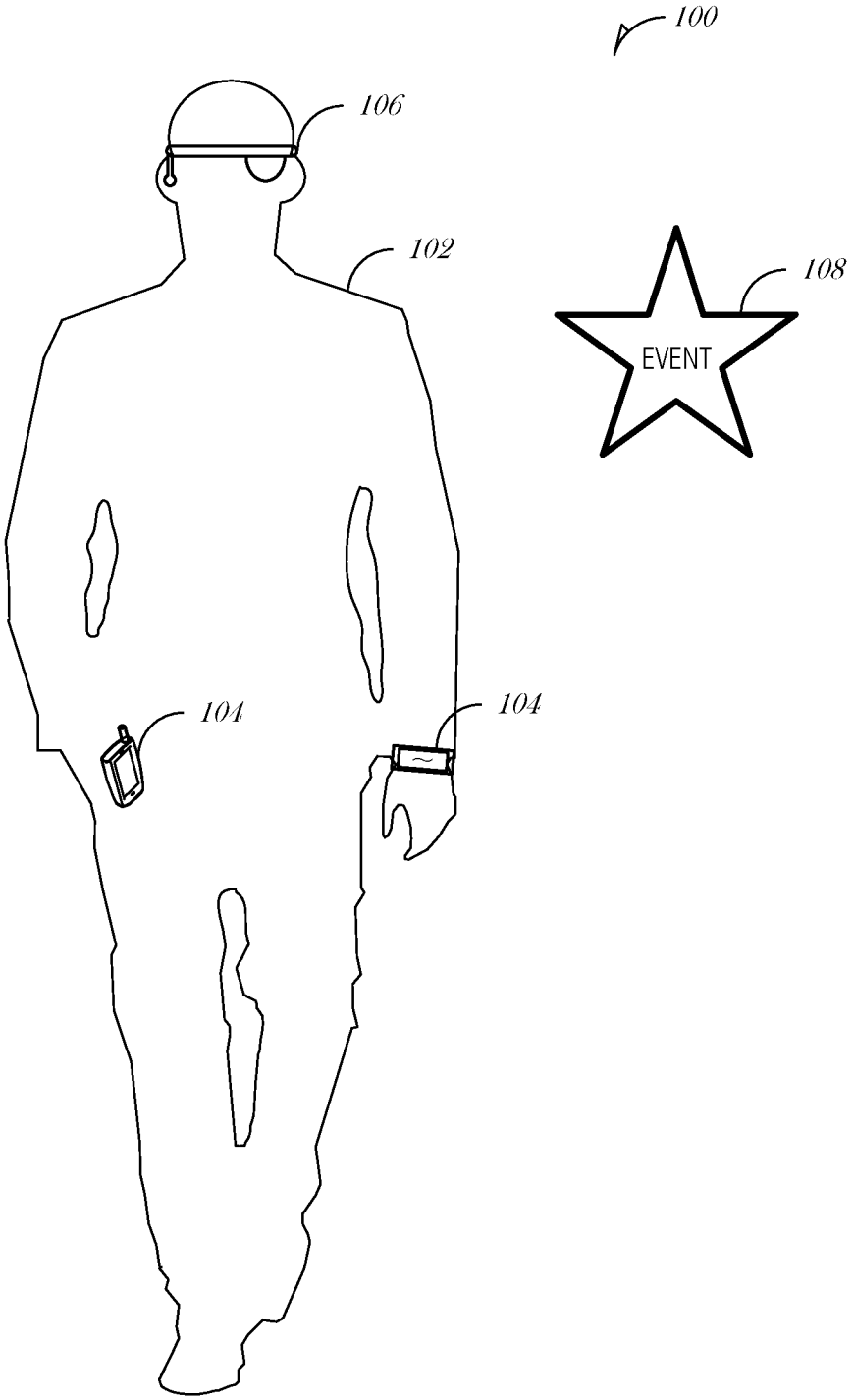
FIG. 1 is a diagram illustrating a user environment, according to an embodiment.

FIG. 1 is a diagram illustrating a user environment 100, according to an embodiment. FIG. 1 includes a user 102 and a user device 104. The user device 104 may be any type of compute device including, but not limited to a mobile phone, a smartphone, a phablet, a tablet, a personal digital assistant, a laptop, a digital camera, smartglasses, a smartwatch, a wearable device, or the like. The user 102 is also wearing headphones 106. The headphones 106 may be earbuds, earphones, a headset, or other speaker device incorporated into another head-worn device (e.g., an earphone incorporated into a glasses-based head-worn wearable device). The headphones 106 may include one or two speakers. The headphones 106 are used to listen to an audio signal being produced by the user device 104. For example, the user 102 may be participating in a phone call, listening to music, playing a video game, surfing the web, or watching a movie on the user device 104. While the user 102 is using the headphones 106, an event 108 occurs near the user 102. The event 108 may be any type of event that is detectable by sound, vibration, light, or the like. Examples of events include, but are not limited to an ambulance approaching, a weather siren, a person calling out to the user 102, an earthquake, a gunshot, or a honking horn.

During operation, the user 102 may configure the user device 104 to detect one or more events 108 or event types. The events 108 or event types may be prioritized by importance and associated with various notification mechanisms. The user device 104 may execute one or more applications (or apps) that are used to monitor the user environment 100 and notify the user 102 based on events 108 detected. The applications may run in the cloud so that the user 102 is able to use various devices and each device is configured with the same user preferences.

The user device 104 includes a sound processing service (SPS) that listens to the user environment 100 and identifies events. The SPS may include various components, such as a natural language processor (NLP) service, a speech recognition service, a speaker identification service, or the like. The NLP service may monitor ongoing conversations or detected speech to determine content and context. The speech recognition service, which may be incorporated into the NLP service or may operate independently, is able to parse detected sounds to identify spoken words or phrases. The speaker identification service is used to identify a particular person or speaker using voice analysis and voice identification processing.

The SPS is able to use one or more of the components to detect and identify events. For example, if the user 102 is listening to music and someone calls her name, this event 108 may be identified as a "friend trying to talk to you" event. Moreover, the person's voice may be analyzed with a speaker identification service to determine whether the person is someone the user 102 knows. If the person is known to the user 102 a different notification may be presented to the user 102 by the user device 104. As another example, the NLP service may detect or identify certain words or sounds that imply certain dangers. Words such as "fire, fire!" or sounds such as screaming or crying, may be identified as an "emergency" event type.

A contextual processor (CP) may also be used independently from the NLP service or in combination with the NLP service. The CP may be used to track the context of the user environment 100. For example, the user's location, daily schedule, current travel route, or other information may be used to infer the context of the user environment 100. Many context factors may be taken into consideration, such as location, means of transportation, daily route, calendar entries, gender, age, health status, time of day, day of week, or the like.

In addition to the NLP service and the CP, various sensors installed in or around the user device 104 may be used to detect or identify various aspects of the event 108. Sensors such as a microphone, a camera, a positioning system (e.g., global positioning system (GPS)), a gyroscope, a photosensor, or the like. For example, a decibel (dB) sensor may be configured to detect a loud noise, such as a car honking or a train whistle, and provide feedback or information to the user 102. Additional sensors may be used to determine whether the headphones 106 are currently in use.

When the event 108 is detected and is determined to be one that the user 102 should be notified of, a notification process may be initiated. The notification process may perform one or more actions, such as reducing the volume of the audio playback, pausing a media playback, vibrating the user device 102 (or other haptic feedback), flashing a screen or presenting a message on the user device 102, or playing an audible notification (e.g., a series of beeps) over the headphones 106.

Figure 2:
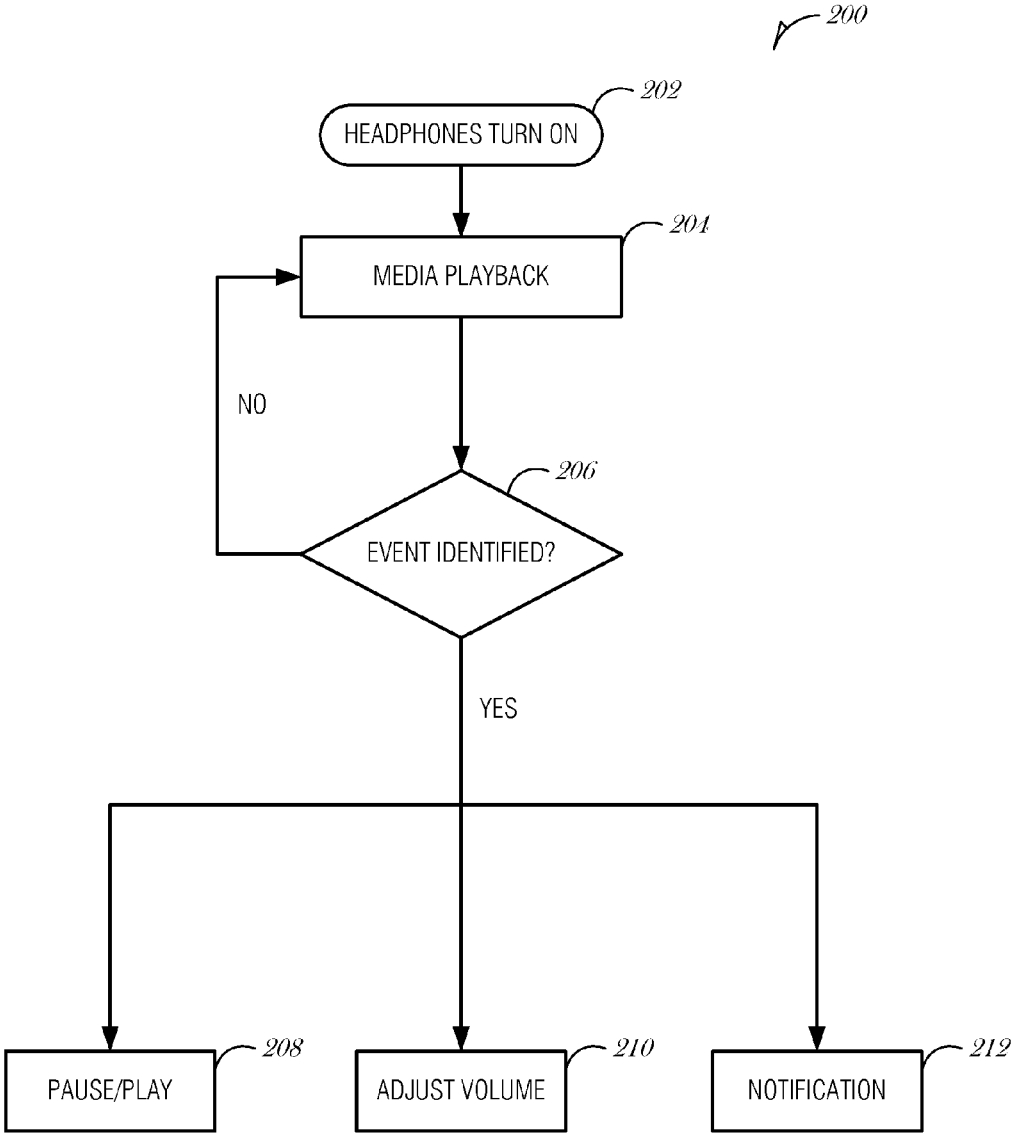
FIG. 2 is a flowchart illustrating control and data flow during operation, according to an embodiment.

FIG. 2 is a flowchart illustrating control and data flow during operation, according to an embodiment. At operation 202, headphones are turned on. The headphones may be passive and activated only when media is played (operation 204). This is typical especially with wired headphones, e.g., those that are hardwired to the playback device. With wireless headphones, there may be a separate power control that is first activated before the headphones produce sound output.

At operation 204, media is played back. The media playback may be stored media such as a music file or a game, or streamed media, such as a movie or radio. Other forms of media playback are included such as teleconferencing, video chat, phone calls, or the like.

At operation 206, it is determined whether an event is identified. The event may be identified by voice analysis, speaker identification, analyzing context, etc. Also at operation 206, it is determined whether an identified event is one that is interesting to the user. Whether an event is interesting may be determined by referencing user preferences, identified a speaker who is known to the user, identified an emergency situation that is relevant to the user, filtering event information based on context, etc.

When there is an event that is likely interesting to the user, then one or more notification modalities may be implemented. The media playback may be paused temporarily (operation 208) so that the user is alerted to the environment and the event. The volume of the media playback may be adjusted (operation 210), for example muting or reducing the volume to a very low output so that the user is brought to attention and also is able to hear ambient noises. A notification may be presented (operation 212) by various modalities. For example, the user's smartwatch may buzz (e.g., haptic feedback), an alarm sound may be played over the media playback, which may be performed in combination with reducing or muting the sound of the playback, or a visual alert may be presented. The visual alert may be various alert types, such as a blinking light, a message on a screen, or a flashing icon. Other visual, audio, and haptic alerts may be used to notify the user of the event.

Figure 3:
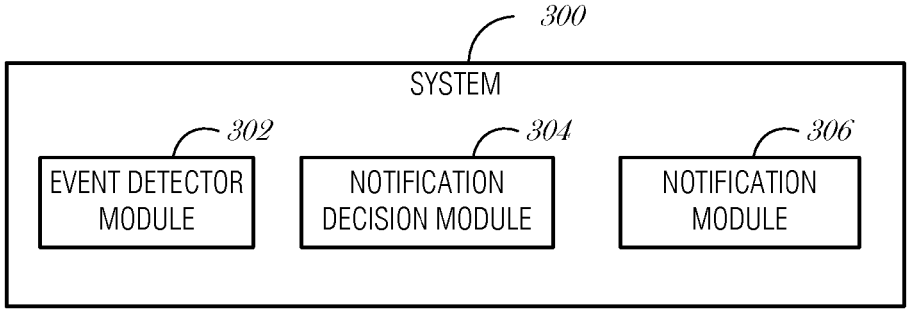
FIG. 3 is a block diagram illustrating a system for providing contextual information to a user while the user is wearing headphones, according to an embodiment.

FIG. 3 is a block diagram illustrating a system 300 for providing contextual information to a user while the user is wearing headphones, according to an embodiment. The system 300 includes an event detector module 302, a notification decision module 304, and a notification module 306. The event detector module 302 may be configured to detect an event external and proximate to a user device, the user device communicatively coupled to headphones worn by a user, the headphones producing sound at a first volume. Events external to the user device are events that occur outside of the user device. For example, a car horn is external to a user's portable music player device. Conversely, an email received at the user device is considered internal with respect to the user device. Also, proximate to the user device means that the user device is able to detect the sound associated with the event. Event proximity to the user device may be further filtered or defined by rules, artificial intelligence, or the like. For example, a car horn detected within 50 feet of the user may be considered proximate to the user device, but a car horn detected over 200 feet away from the user device may not be considered proximate. In another case though where a weather alert siren is detected, which may have originated miles away, the weather alert siren may be considered proximate to the user device.

The notification decision module 304 may be configured to determine whether to notify the user of the event. The user need not be notified of every proximate event that occurs. Doing so would defeat the purpose of the system—that is to allow the user to listen to the sound from the headphones without undue interruption. The notification module 306 may be configured to notify the user of the event based on the determination. Various notification modalities may be used. The notifications or types of notifications may be activated or deactivated by user input or user configuration. When a notification is provided, various mechanisms may be used to dismiss the notification, such as acknowledging the notification with a user interface control.

In an embodiment, to detect the event, the event detector module 302 is to use a sound processor to detect an ambient sound, analyze the ambient sound and determine the event based on the ambient sound. In a further embodiment, the ambient sound comprises a spoken word, and to analyze the ambient sound, the event detector module 302 is to identifying the spoken word. In such an embodiment, to determine the event based on the ambient sound, the event detector module 302 is to determine whether the spoken word is directed to the user. Various sound analyses may be used, such as speech recognition to determine whether the spoken word is the user's name or a reference to the user (e.g., "friend," "Dad," or a nickname).

In a further embodiment, the ambient sound comprises a spoken word, and to analyze the ambient sound, the event detector module 302 is to identify the spoken word. In such an embodiment, to determine the event based on the ambient sound, the event detector module 302 is to determine whether the spoken word is a call for assistance. Examples of a call for assistance include, but are not limited to "help," "fire," or "call 911."

In a further embodiment, the ambient sound comprises a non-verbal sound, and to analyze the ambient sound, and the event detector module 302 is to identify the non-verbal sound. In such an embodiment, to determine the event based on the ambient sound, the event detector module 302 is to determine whether the non-verbal sound is an alarm. In various embodiments, the alarm is one of: an automobile horn, a weather siren, a fire alarm, or an emergency vehicle siren. Other types of alarms are included in the scope of this disclosure.

In an embodiment, to determine whether to notify the user, the notification decision module 304 is to access user preferences to identify an event prioritization hierarchy, identify an event priority of the event from the event prioritization hierarchy, and when the event priority exceeds a threshold, determine to notify the user. Events may prioritized or ranked by the user such that higher priority events may be associated with different or additional notification modalities than those notifications used with lower priority events.

In an embodiment, to determine whether to notify the user, the notification decision module 304 is to identify an event type of the event and determine to notify the user based on the event type. Event types may be provided by a central provider or user defined. Examples of event types include, but are not limited to "emergency event," "friend hailing event," and "informational event."

In an embodiment, to detect the event, the event detection module 302 is to use a sound processor to detect an ambient sound, and the ambient sound comprises a spoken word. In such an embodiment, to determine whether to notify the user, the notification decision module 304 is to obtain an identity of a speaker of the spoken word, determine whether the speaker is associated with the user, and determine to notify the user of the event based on whether the speaker is associated with the user. Speech recognition and identification may be used to identify the speaker. The user may configure notification modalities based on the speaker's identity. Speakers may be placed in categories, such as "friends" or "family" with notification mechanisms associated with the categories. The notification mechanisms may be different for different categories, and may be user-assigned or user-defined.

In an embodiment, to notify the user, the notification module 306 is to provide an audible feedback to the user. In a further embodiment, the audible feedback comprises a tone. The tone may be played over the headphones.

In an embodiment, to provide the audible feedback, the notification module 306 is to produce the sound at a second volume at the headphones. In a further embodiment, the second volume is a lower volume than the first volume. In another embodiment, the second volume is a muted volume. For example, the volume may be completely silenced (e.g., muted) by temporarily terminating sound output to the headphones. In an embodiment, to provide the audible feedback, the notification module 306 is to mute the sound to the headphones.

In an embodiment, to notify the user, the notification module 306 is to provide a haptic feedback to the user. Haptic feedback may include one or more vibrations either singly or in a pattern. The haptic feedback may be distinguishable based on event type, event, speaker identification, speaker categorization, or the like. In a further embodiment, the haptic feedback is provided by the user device. For example, the user may be listening to a music file on a smartphone. When an event is detected, the smartphone may vibrate one or more times. In another embodiment, the haptic feedback is provided by a second device communicatively coupled to the user device. Continuing the example, the smartphone may be communicatively connected to a smartwatch also used by the user. The smartwatch may vibrate alone or in concert with the smartphone. Thus, in an embodiment, the second device is a wearable device. Various wearable devices may be used other than a smartwatch, such as smartglasses, e-textiles, shoe inserts, bracelets, gloves, or the like.

In an embodiment, to notify the user, the notification module 306 is to provide a visual feedback to the user. In a further embodiment, to provide the visual feedback to the user, the notification module 306 is to present a message on the user device. For example, where the user device is a smartphone, a message may be presented on the smartphone's display. Alternatively, the message may be a scrolling display, a blinking light, a flashing screen, or other mechanisms to attract the user's attention.

Figure 4:
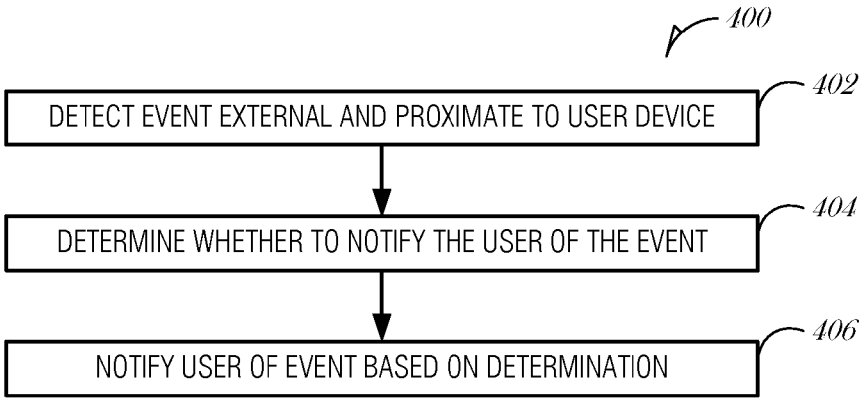
FIG. 4 is a flowchart illustrating a method of providing contextual information to a user while the user is wearing headphones, according to an embodiment.

FIG. 4 is a flowchart illustrating a method 400 of providing contextual information to a user while the user is wearing headphones, according to an embodiment. At block 402, an event external and proximate to a user device, is detect by the user device, the user device communicatively coupled to headphones worn by a user, the headphones producing sound at a first volume. At block 404, it is determined whether to notify the user of the event and at block 406, the user is notified of the event based on the determination.

In an embodiment, detecting the event comprises using a sound processor to detect an ambient sound, analyzing the ambient sound, and determining the event based on the ambient sound.

In a further embodiment, the ambient sound comprises a spoken word, analyzing the ambient sound comprises identifying the spoken word, and determining the event based on the ambient sound comprises determining whether the spoken word is directed to the user.

In a further embodiment, the ambient sound comprises a spoken word, analyzing the ambient sound comprises identifying the spoken word, and determining the event based on the ambient sound comprises determining whether the spoken word is a call for assistance.

In a further embodiment, the ambient sound comprises a non-verbal sound, analyzing the ambient sound comprises identifying the non-verbal sound, and determining the event based on the ambient sound comprises determining whether the non-verbal sound is an alarm. In various embodiments, the alarm is one of: an automobile horn, a weather siren, a fire alarm, or an emergency vehicle siren.

In an embodiment, determining whether to notify the user comprises accessing user preferences to identify an event prioritization hierarchy, identifying an event priority of the event from the event prioritization hierarchy, and when the event priority exceeds a threshold, determining to notify the user.

In an embodiment, determining whether to notify the user comprises identifying an event type of the event, and determining to notify the user based on the event type.

In an embodiment, detecting the event comprises using a sound processor to detect an ambient sound, the ambient sound comprises a spoken word, and determining whether to notify the user comprises obtaining an identity of a speaker of the spoken word, determining whether the speaker is associated with the user, and determining to notify the user of the event based on whether the speaker is associated with the user.

In an embodiment, notifying the user comprises providing an audible feedback to the user. In a further embodiment, the audible feedback comprises a tone. In another embodiment, providing the audible feedback to the user comprises producing the sound at a second volume at the headphones. In a further embodiment, the second volume is a lower volume than the first volume. In a further embodiment, the second volume is a muted volume. In an embodiment, providing the audible feedback to the user comprises muting the sound to the headphones.

In an embodiment, notifying the user comprises providing a haptic feedback to the user. In a further embodiment, the haptic feedback is provided by the user device. In another embodiment, the haptic feedback is provided by a second device communicatively coupled to the user device. In an embodiment, the second device is a wearable device.

In an embodiment, notifying the user comprises providing a visual feedback to the user. In a further embodiment, providing the visual feedback to the user comprises presenting a message on the user device.

Embodiments may be implemented in one or a combination of hardware, firmware, and software. Embodiments may also be implemented as instructions stored on a machine-readable storage device, which may be read and executed by at least one processor to perform the operations described herein. A machine-readable storage device may include any non-transitory mechanism for storing information in a form readable by a machine (e.g., a computer). For example, a machine-readable storage device may include read-only memory (ROM), random-access memory (RAM), magnetic disk storage media, optical storage media, flash-memory devices, and other storage devices and media.

Examples, as described herein, may include, or may operate on, logic or a number of components, modules, or mechanisms. Modules may be hardware, software, or firmware communicatively coupled to one or more processors in order to carry out the operations described herein. Modules may be hardware modules, and as such modules may be considered tangible entities capable of performing specified operations and may be configured or arranged in a certain manner. In an example, circuits may be arranged (e.g., internally or with respect to external entities such as other circuits) in a specified manner as a module. In an example, the whole or part of one or more computer systems (e.g., a standalone, client or server computer system) or one or more hardware processors may be configured by firmware or software (e.g., instructions, an application portion, or an application) as a module that operates to perform specified operations. In an example, the software may reside on a machine-readable medium. In an example, the software, when executed by the underlying hardware of the module, causes the hardware to perform the specified operations. Accordingly, the term hardware module is understood to encompass a tangible entity, be that an entity that is physically constructed, specifically configured (e.g., hardwired), or temporarily (e.g., transitorily) configured (e.g., programmed) to operate in a specified manner or to perform part or all of any operation described herein. Considering examples in which modules are temporarily configured, each of the modules need not be instantiated at any one moment in time. For example, where the modules comprise a general-purpose hardware processor configured using software; the general-purpose hardware processor may be configured as respective different modules at different times. Software may accordingly configure a hardware processor, for example, to constitute a particular module at one instance of time and to constitute a different module at a different instance of time. Modules may also be software or firmware modules, which operate to perform the methodologies described herein.

Figure 5:
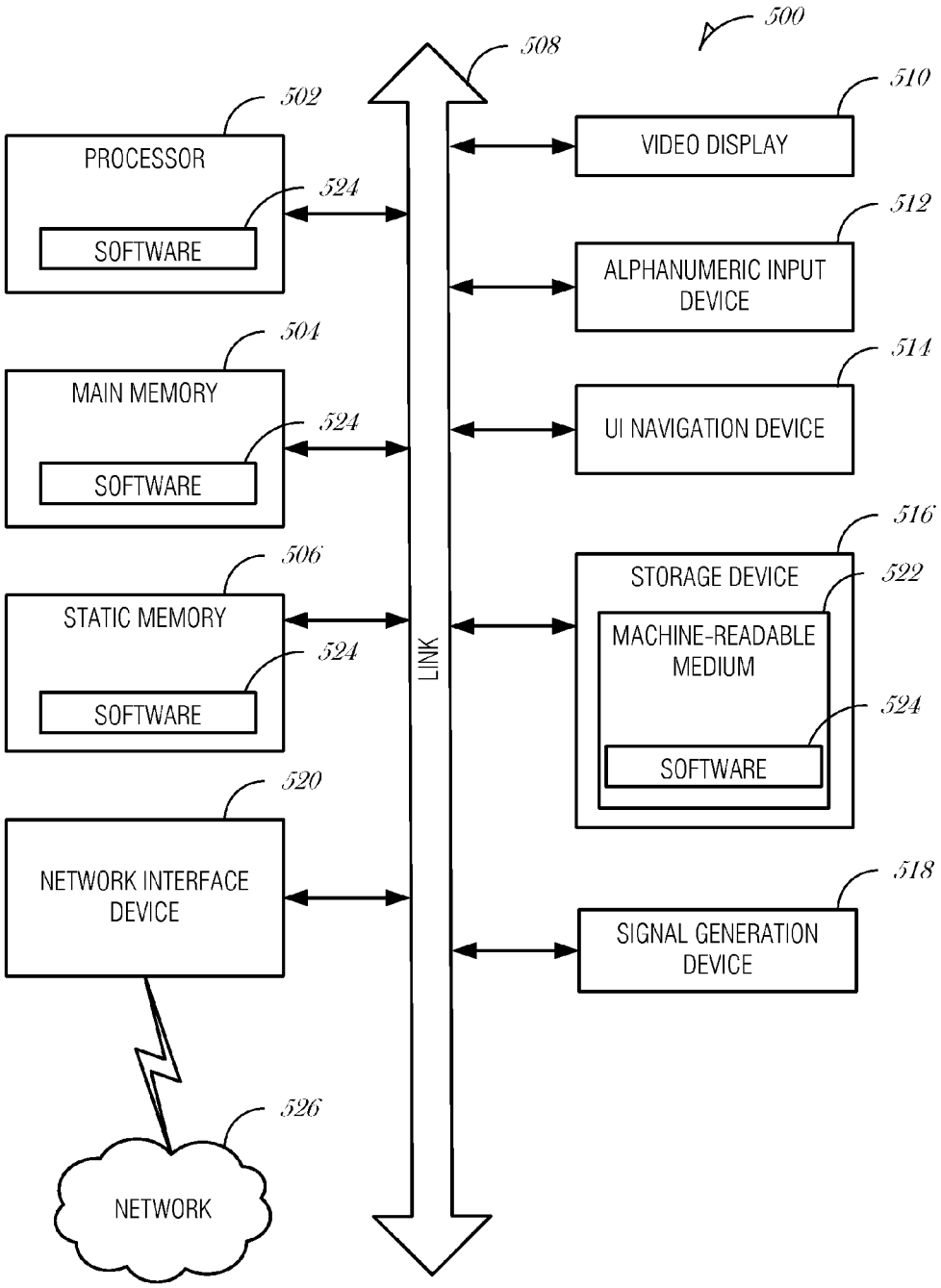
FIG. 5 is a block diagram illustrating an example machine upon which any one or more of the techniques (e.g., methodologies) discussed herein may perform, according to an example embodiment.

FIG. 5 is a block diagram illustrating a machine in the example form of a computer system 500, within which a set or sequence of instructions may be executed to cause the machine to perform any one of the methodologies discussed herein, according to an example embodiment. In alternative embodiments, the machine operates as a standalone device or may be connected (e.g., networked) to other machines. In a networked deployment, the machine may operate in the capacity of either a server or a client machine in server-client network environments, or it may act as a peer machine in peer-to-peer (or distributed) network environments. The machine may be an onboard vehicle system, set-top box, wearable device, personal computer (PC), a tablet PC, a hybrid tablet, a personal digital assistant (PDA), a mobile telephone, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein. Similarly, the term "processor-based system" shall be taken to include any set of one or more machines that are controlled by or operated by a processor (e.g., a computer) to individually or jointly execute instructions to perform any one or more of the methodologies discussed herein.

Example computer system 500 includes at least one processor 502 (e.g., a central processing unit (CPU), a graphics processing unit (GPU) or both, processor cores, compute nodes, etc.), a main memory 504 and a static memory 506, which communicate with each other via a link 508 (e.g., bus). The computer system 500 may further include a video display unit 510, an alphanumeric input device 512 (e.g., a keyboard), and a user interface (UI) navigation device 514 (e.g., a mouse). In one embodiment, the video display unit 510, input device 512 and UI navigation device 514 are incorporated into a touch screen display. The computer system 500 may additionally include a storage device 516 (e.g., a drive unit), a signal generation device 518 (e.g., a speaker), a network interface device 520, and one or more sensors (not shown), such as a global positioning system (GPS) sensor, compass, accelerometer, or other sensor.

The storage device 516 includes a machine-readable medium 522 on which is stored one or more sets of data structures and instructions 524 (e.g., software) embodying or utilized by any one or more of the methodologies or functions described herein. The instructions 524 may also reside, completely or at least partially, within the main memory 504, static memory 506, and/or within the processor 502 during execution thereof by the computer system 500, with the main memory 504, static memory 506, and the processor 502 also constituting machine-readable media.

While the machine-readable medium 522 is illustrated in an example embodiment to be a single medium, the term "machine-readable medium" may include a single medium or multiple media (e.g., a centralized or distributed database, and/or associated caches and servers) that store the one or more instructions 524. The term "machine-readable medium" shall also be taken to include any tangible medium that is capable of storing, encoding or carrying instructions for execution by the machine and that cause the machine to perform any one or more of the methodologies of the present disclosure or that is capable of storing, encoding or carrying data structures utilized by or associated with such instructions. The term "machine-readable medium" shall accordingly be taken to include, but not be limited to, solid-state memories, and optical and magnetic media. Specific examples of machine-readable media include non-volatile memory, including but not limited to, by way of example, semiconductor memory devices (e.g., electrically programmable read-only memory (EPROM), electrically erasable programmable read-only memory (EEPROM)) and flash memory devices; magnetic disks such as internal hard disks and removable disks; magneto-optical disks; and CD-ROM and DVD-ROM disks.

The instructions 524 may further be transmitted or received over a communications network 526 using a transmission medium via the network interface device 520 utilizing any one of a number of well-known transfer protocols (e.g., HTTP). Examples of communication networks include a local area network (LAN), a wide area network (WAN), the Internet, mobile telephone networks, plain old telephone (POTS) networks, and wireless data networks (e.g., Wi-Fi, 3G, and 4G LTE/LTE-A or WiMAX networks). The term "transmission medium" shall be taken to include any intangible medium that is capable of storing, encoding, or carrying instructions for execution by the machine, and includes digital or analog communications signals or other intangible medium to facilitate communication of such software.

ADDITIONAL NOTES & EXAMPLES

Example 1 includes subject matter for providing contextual information to a user while the user is wearing headphones (such as a device, apparatus, or machine) comprising: an event detector module to detect an event external and proximate to a user device, the user device communicatively coupled to headphones worn by the user, the headphones producing sound at a first volume; a notification decision module to determine whether to notify the user of the event; and a notification module to notify the user of the event based on the determination.

In Example 2, the subject matter of Example 1 may include, wherein to detect the event, the event detector module is to: use a sound processor to detect an ambient sound; analyze the ambient sound; and determine the event based on the ambient sound.

In Example 3, the subject matter of any one of Examples 1 to 2 may include, wherein the ambient sound comprises a spoken word, wherein to analyze the ambient sound, the event detector module is to identifying the spoken word, and wherein to determine the event based on the ambient sound, the event detector module is to determine whether the spoken word is directed to the user.

In Example 4, the subject matter of any one of Examples 1 to 3 may include, wherein the ambient sound comprises a spoken word, wherein to analyze the ambient sound, the event detector module is to identify the spoken word, and wherein to determine the event based on the ambient sound, the event detector module is to determine whether the spoken word is a call for assistance.

In Example 5, the subject matter of any one of Examples 1 to 4 may include, wherein the ambient sound comprises a non-verbal sound, wherein to analyze the ambient sound, the event detector module is to identify the non-verbal sound, and wherein to determine the event based on the ambient sound, the event detector module is to determine whether the non-verbal sound is an alarm.

In Example 6, the subject matter of any one of Examples 1 to 5 may include, wherein the alarm is one of: an automobile horn, a weather siren, a fire alarm, or an emergency vehicle siren.

In Example 7, the subject matter of any one of Examples 1 to 6 may include, wherein to determine whether to notify the user, the notification decision module is to: access user preferences to identify an event prioritization hierarchy; identify an event priority of the event from the event prioritization hierarchy; and when the event priority exceeds a threshold, determine to notify the user.

In Example 8, the subject matter of any one of Examples 1 to 7 may include, wherein to determine whether to notify the user, the notification decision module is to: identify an event type of the event; and determine to notify the user based on the event type.

In Example 9, the subject matter of any one of Examples 1 to 8 may include, wherein to detect the event, the event detection module is to use a sound processor to detect an ambient sound, wherein the ambient sound comprises a spoken word, and wherein to determine whether to notify the user, the notification decision module is to: obtain an identity of a speaker of the spoken word; determine whether the speaker is associated with the user; and determine to notify the user of the event based on whether the speaker is associated with the user.

In Example 10, the subject matter of any one of Examples 1 to 9 may include, wherein to notify the user, the notification module is to provide an audible feedback to the user.

In Example 11, the subject matter of any one of Examples 1 to 10 may include, wherein the audible feedback comprises a tone.

In Example 12, the subject matter of any one of Examples 1 to 11 may include, wherein to provide the audible feedback, the notification module is to produce the sound at a second volume at the headphones.

In Example 13, the subject matter of any one of Examples 1 to 12 may include, wherein the second volume is a lower volume than the first volume.

In Example 14, the subject matter of any one of Examples 1 to 13 may include, wherein to provide the audible feedback, the notification module is to mute the sound to the headphones.

In Example 15, the subject matter of any one of Examples 1 to 14 may include, wherein to notify the user, the notification module is to provide a haptic feedback to the user.

In Example 16, the subject matter of any one of Examples 1 to 15 may include, wherein the haptic feedback is provided by the user device.

In Example 17, the subject matter of any one of Examples 1 to 16 may include, wherein the haptic feedback is provided by a second device communicatively coupled to the user device.

In Example 18, the subject matter of any one of Examples 1 to 17 may include, wherein the second device is a wearable device.

In Example 19, the subject matter of any one of Examples 1 to 18 may include, wherein to notify the user, the notification module is to provide a visual feedback to the user.

In Example 20, the subject matter of any one of Examples 1 to 19 may include, wherein to provide the visual feedback to the user, the notification module is to present a message on the user device.

Example 21 includes subject matter for providing contextual information to a user while the user is wearing headphones (such as a method, means for performing acts, machine readable medium including instructions that when performed by a machine cause the machine to performs acts, or an apparatus to perform) comprising: detecting, by a user device, an event external and proximate to the user device, the user device communicatively coupled to headphones worn by the user, the headphones producing sound at a first volume; determining whether to notify the user of the event; and notifying the user of the event based on the determination.

In Example 22, the subject matter of Example 21 may include, wherein detecting the event comprises: using a sound processor to detect an ambient sound; analyzing the ambient sound; and determining the event based on the ambient sound.

In Example 23, the subject matter of any one of Examples 21 to 22 may include, wherein the ambient sound comprises a spoken word, wherein analyzing the ambient sound comprises identifying the spoken word, and wherein determining the event based on the ambient sound comprises determining whether the spoken word is directed to the user.

In Example 24, the subject matter of any one of Examples 21 to 23 may include, wherein the ambient sound comprises a spoken word, wherein analyzing the ambient sound comprises identifying the spoken word, and wherein determining the event based on the ambient sound comprises determining whether the spoken word is a call for assistance.

In Example 25, the subject matter of any one of Examples 21 to 24 may include, wherein the ambient sound comprises a non-verbal sound, wherein analyzing the ambient sound comprises identifying the non-verbal sound, and wherein determining the event based on the ambient sound comprises determining whether the non-verbal sound is an alarm.

In Example 26, the subject matter of any one of Examples 21 to 25 may include, wherein the alarm is one of: an automobile horn, a weather siren, a fire alarm, or an emergency vehicle siren.

In Example 27, the subject matter of any one of Examples 21 to 26 may include, wherein determining whether to notify the user comprises: accessing user preferences to identify an event prioritization hierarchy; identifying an event priority of the event from the event prioritization hierarchy; and when the event priority exceeds a threshold, determining to notify the user.

In Example 28, the subject matter of any one of Examples 21 to 27 may include, wherein determining whether to notify the user comprises: identifying an event type of the event; and determining to notify the user based on the event type.

In Example 29, the subject matter of any one of Examples 21 to 28 may include, wherein detecting the event comprises using a sound processor to detect an ambient sound, wherein the ambient sound comprises a spoken word, and wherein determining whether to notify the user comprises: obtaining an identity of a speaker of the spoken word; determining whether the speaker is associated with the user; and determining to notify the user of the event based on whether the speaker is associated with the user.

In Example 30, the subject matter of any one of Examples 21 to 29 may include, wherein notifying the user comprises providing an audible feedback to the user.

In Example 31, the subject matter of any one of Examples 21 to 30 may include, wherein the audible feedback comprises a tone.

In Example 32, the subject matter of any one of Examples 21 to 31 may include, wherein providing the audible feedback to the user comprises producing the sound at a second volume at the headphones.

In Example 33, the subject matter of any one of Examples 21 to 32 may include, wherein the second volume is a lower volume than the first volume.

In Example 34, the subject matter of any one of Examples 21 to 33 may include, wherein providing the audible feedback to the user comprises muting the sound to the headphones.

In Example 35, the subject matter of any one of Examples 21 to 34 may include, wherein notifying the user comprises providing a haptic feedback to the user.

In Example 36, the subject matter of any one of Examples 21 to 35 may include, wherein the haptic feedback is provided by the user device.

In Example 37, the subject matter of any one of Examples 21 to 36 may include, wherein the haptic feedback is provided by a second device communicatively coupled to the user device.

In Example 38, the subject matter of any one of Examples 21 to 37 may include, wherein the second device is a wearable device.

In Example 39, the subject matter of any one of Examples 21 to 38 may include, wherein notifying the user comprises providing a visual feedback to the user.

In Example 40, the subject matter of any one of Examples 21 to 39 may include, wherein providing the visual feedback to the user comprises presenting a message on the user device.

Example 41 includes at least one machine-readable medium including instructions, which when executed by a machine, cause the machine to perform operations of any of the Examples 21-40.

Example 42 includes an apparatus comprising means for performing any of the Examples 21-40.

Example 43 includes subject matter for providing contextual information to a user while the user is wearing headphones (such as a device, apparatus, or machine) comprising: means for detecting, by a user device, an event external and proximate to the user device, the user device communicatively coupled to headphones worn by the user, the headphones producing sound at a first volume; means for determining whether to notify the user of the event; and means for notifying the user of the event based on the determination.

In Example 44, the subject matter of Example 43 may include, wherein the means for detecting the event comprise: means for using a sound processor to detect an ambient sound; means for analyzing the ambient sound; and means for determining the event based on the ambient sound.

In Example 45, the subject matter of any one of Examples 43 to 44 may include, wherein the ambient sound comprises a spoken word, wherein the means for analyzing the ambient sound comprise means for identifying the spoken word, and wherein the means for determining the event based on the ambient sound comprise means for determining whether the spoken word is directed to the user.

In Example 46, the subject matter of any one of Examples 43 to 45 may include, wherein the ambient sound comprises a spoken word, wherein the means for analyzing the ambient sound comprise means for identifying the spoken word, and wherein the means for determining the event based on the ambient sound comprise means for determining whether the spoken word is a call for assistance.

In Example 47, the subject matter of any one of Examples 43 to 46 may include, wherein the ambient sound comprises a non-verbal sound, wherein the means for analyzing the ambient sound comprise means for identifying the non-verbal sound, and wherein the means for determining the event based on the ambient sound comprise means for determining whether the non-verbal sound is an alarm.

In Example 48, the subject matter of any one of Examples 43 to 47 may include, wherein the alarm is one of: an automobile horn, a weather siren, a fire alarm, or an emergency vehicle siren.

In Example 49, the subject matter of any one of Examples 43 to 48 may include, wherein the determining whether to notify the user comprise: means for accessing user preferences to identify an event prioritization hierarchy; means for identifying an event priority of the event from the event prioritization hierarchy; and means for when the event priority exceeds a threshold, determining to notify the user.

In Example 50, the subject matter of any one of Examples 43 to 49 may include, wherein the means for determining whether to notify the user comprise: means for identifying an event type of the event; and means for determining to notify the user based on the event type.

In Example 51, the subject matter of any one of Examples 43 to 50 may include, wherein the means for detecting the event comprise means for using a sound processor to detect an ambient sound, wherein the ambient sound comprises a spoken word, and wherein the means for determining whether to notify the user comprise: means for obtaining an identity of a speaker of the spoken word; means for determining whether the speaker is associated with the user; and means for determining to notify the user of the event based on whether the speaker is associated with the user.

In Example 52, the subject matter of any one of Examples 43 to 51 may include, wherein the means for notifying the user comprise means for providing an audible feedback to the user.

In Example 53, the subject matter of any one of Examples 43 to 52 may include, wherein the audible feedback comprises a tone.

In Example 54, the subject matter of any one of Examples 43 to 53 may include, wherein the means for providing the audible feedback to the user comprise means for producing the sound at a second volume at the headphones.

In Example 55, the subject matter of any one of Examples 43 to 54 may include, wherein the second volume is a lower volume than the first volume.

In Example 56, the subject matter of any one of Examples 43 to 55 may include, wherein the means for providing the audible feedback to the user comprise means for muting the sound to the headphones.

In Example 57, the subject matter of any one of Examples 43 to 56 may include, wherein the means for notifying the user comprise means for providing a haptic feedback to the user.

In Example 58, the subject matter of any one of Examples 43 to 57 may include, wherein the haptic feedback is provided by the user device.

In Example 59, the subject matter of any one of Examples 43 to 58 may include, wherein the haptic feedback is provided by a second device communicatively coupled to the user device.

In Example 60, the subject matter of any one of Examples 43 to 59 may include, wherein the second device is a wearable device.

In Example 61, the subject matter of any one of Examples 43 to 60 may include, wherein the means for notifying the user comprise means for providing a visual feedback to the user.

In Example 62, the subject matter of any one of Examples 43 to 61 may include, wherein the means for providing the visual feedback to the user comprise means for presenting a message on the user device.

The above detailed description includes references to the accompanying drawings, which form a part of the detailed description. The drawings show, by way of illustration, specific embodiments that may be practiced. These embodiments are also referred to herein as "examples." Such examples may include elements in addition to those shown or described. However, also contemplated are examples that include the elements shown or described. Moreover, also contemplated are examples using any combination or permutation of those elements shown or described (or one or more aspects thereof), either with respect to a particular example (or one or more aspects thereof), or with respect to other examples (or one or more aspects thereof) shown or described herein.

Publications, patents, and patent documents referred to in this document are incorporated by reference herein in their entirety, as though individually incorporated by reference. In the event of inconsistent usages between this document and those documents so incorporated by reference, the usage in the incorporated reference(s) are supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to suggest a numerical order for their objects.

The above description is intended to be illustrative, and not restrictive. For example, the above-described examples (or one or more aspects thereof) may be used in combination with others. Other embodiments may be used, such as by one of ordinary skill in the art upon reviewing the above description. The Abstract is to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. However, the claims may not set forth every feature disclosed herein as embodiments may feature a subset of said features. Further, embodiments may include fewer features than those disclosed in a particular example. Thus, the following claims are hereby incorporated into the Detailed Description, with a claim standing on its own as a separate embodiment. The scope of the embodiments disclosed herein is to be determined with reference to the appended claims, along with the full scope of equivalents to which such claims are entitled.

What is claimed is:

1. A system for providing contextual information to a user while the user is wearing headphones, the system comprising:

an event detector module to detect an event external and proximate to a user device, the user device communicatively coupled to headphones worn by the user, the headphones producing sound at a first volume, wherein to detect the event, the event detection module is to use a sound processor to detect an ambient sound, wherein the ambient sound comprises a spoken word;

a notification decision module to determine whether to notify the user of the event; and a notification module to notify the user of the event based on the determination, wherein to determine whether to notify the user, the notification decision module is to: obtain an identity of a speaker of the spoken word;

determine whether the speaker is associated with the user; and determine to notify the user of the event based on whether the speaker is associated with the user.

2. The system of claim 1, wherein to detect the event, the event detector module is to:

use a sound processor to detect an ambient sound;

analyze the ambient sound; and determine the event based on the ambient sound.

3. The system of claim 2, wherein to analyze the ambient sound, the event detector module is to identify the spoken word, and wherein to determine the event based on the ambient sound, the event detector module is to determine whether the spoken word is directed to the user.

4. The system of claim 2, wherein to analyze the ambient sound, the event detector module is to identify the spoken word, and wherein to determine the event based on the ambient sound, the event detector module is to determine whether the spoken word is a call for assistance.

5. The system of claim 2, wherein the ambient sound comprises a non-verbal sound, wherein to analyze the ambient sound, the event detector module is to identify the non-verbal sound, and wherein to determine the event based on the ambient sound, the event detector module is to determine whether the non-verbal sound is an alarm.

6. The system of claim 5, wherein the alarm is one of:

an automobile horn, a weather siren, a fire alarm, or an emergency vehicle siren.

7. The system of claim 1, wherein to determine whether to notify the user, the notification decision module is to:

access user preferences to identify an event prioritization hierarchy;

identify an event priority of the event from the event prioritization hierarchy; and when the event priority exceeds a threshold, determine to notify the user.

8. The system of claim 1, wherein to determine whether to notify the user, the notification decision module is to:

identify an event type of the event; and determine to notify the user based on the event type.

9. The system of claim 1, wherein to notify the user, the notification module is to provide an audible feedback to the user.

10. A method of providing contextual information to a user while the user is wearing headphones, the method comprising:

detecting, by a user device, an event external and proximate to the user device, the user device communicatively coupled to headphones worn by the user, the headphones producing sound at a first volume, wherein detecting the event comprises using a sound processor to detect an ambient sound, wherein the ambient sound comprises a spoken word;

determining whether to notify the user of the event; and notifying the user of the event based on the determination, wherein determining whether to notify the user comprises:

obtaining an identity of a speaker of the spoken word;

determining whether the speaker is associated with the user; and determining to notify the user of the event based on whether the speaker is associated with the user.

11. The method of claim 10, wherein notifying the user comprises providing an audible feedback to the user.

12. The method of claim 11, wherein the audible feedback comprises a tone.

13. The method of claim 11, wherein providing the audible feedback to the user comprises producing the sound at a second volume at the headphones.

14. At least one non-transitory machine-readable medium including instructions, which when executed by a machine, cause the machine to:

detect an event external and proximate to a user device, the user device communicatively coupled to headphones worn by a user, the headphones producing sound at a first volume, wherein the instructions to detect the event include instructions to use a sound processor to detect an ambient sound, wherein the ambient sound comprises a spoken word;

determine whether to notify the user of the event; and notify the user of the event based on the determination, wherein the instructions to determine whether to notify the user include instructions to:

obtain an identity of a speaker of the spoken word;

determine whether the speaker is associated with the user; and determine to notify the user of the event based on whether the speaker is associated with the user.

15. The at least one non-transitory machine-readable medium of claim 14, wherein the instructions to detect the event include instructions to:

use a sound processor to detect an ambient sound;

analyze the ambient sound; and determine the event based on the ambient sound.

16. The at least one non-transitory machine-readable medium of claim 15, wherein the instructions to analyze the ambient sound include instructions to identify the spoken word, and wherein the instructions to determine the event based on the ambient sound include instructions to determine whether the spoken word is directed to the user.

17. The at least one non-transitory machine-readable medium of claim 15, wherein the instructions to analyze the ambient sound include instructions to identify the spoken word, and wherein the instructions to determine the event based on the ambient sound include instructions to determine whether the spoken word is a call for assistance.

18. The at least one non-transitory machine-readable medium of claim 15, wherein the ambient sound comprises a non-verbal sound, wherein the instructions to analyze the ambient sound include instructions to identify the non-verbal sound, and wherein the instructions to determine the event based on the ambient sound include instructions to determine whether the non-verbal sound is an alarm.

19. The at least one non-transitory machine-readable medium of claim 18, wherein the alarm is one of:

an automobile horn, a weather siren, a fire alarm, or an emergency vehicle siren.

20. The at least one non-transitory machine-readable medium of claim 14, wherein the instructions to determine whether to notify the user include instructions to:

access user preferences to identify an event prioritization hierarchy;

identify an event priority of the event from the event prioritization hierarchy; and when the event priority exceeds a threshold, determine to notify the user.

21. The at least one non-transitory machine-readable medium of claim 14, wherein the instructions to determine whether to notify the user include instructions to:

identify an event type of the event; and determine to notify the user based on the event type.

22. The at least one non-transitory machine-readable medium of claim 14, wherein the instructions to notify the user include instructions to provide an audible feedback to the user.

* * * * *